US006243047B1

(12) United States Patent
Brown

(10) Patent No.: US 6,243,047 B1
(45) Date of Patent: Jun. 5, 2001

(54) SINGLE MIRROR DUAL AXIS BEAM WAVEGUIDE ANTENNA SYSTEM

(75) Inventor: Kenneth W. Brown, Yucaipa, CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/384,913

(22) Filed: Aug. 27, 1999

(51) Int. Cl.[7] ..... H01Q 19/14

(52) U.S. Cl. ..... 343/781 CA; 343/761; 343/839

(58) Field of Search ..... 343/761, 762, 343/757, 781 CA, 781 P, 781 R, 837, 839, 840; H01Q 19/12, 19/13, 19/14, 19/18, 19/19

(56) References Cited

U.S. PATENT DOCUMENTS 4,044,361 8/1977 Yokoi et al. .
4,186,402 1/1980 Mizusawa et al. .
4,525,719 * 6/1985 Sato et al. ..... 343/761
4,559,540 * 12/1985 Betsudan et al. ..... 343/761
5,459,475 * 10/1995 Shen et al. ..... 343/781 P
5,673,057 * 9/1997 Toland et al. ..... 343/761
6,061,033 * 5/2000 Hulderman et al. ..... 343/781 CA

* cited by examiner

*Primary Examiner*—Tho G Phan
(74) *Attorney, Agent, or Firm*—William J. Benman; Colin M. Raufer; Glenn H. Lenzen, Jr.

(57) ABSTRACT

A dual axis beam waveguide antenna system includes a radiator generating a beam, a mirror which directs the beam to a subreflector, which receives the beam, and a main reflector illuminated by the subreflector, which generates a collimated output. The beam waveguide of the antenna system is characterized by an azimuth axis defined by the radiator and the mirror and an elevation axis defined by the mirror and the subreflector.

8 Claims, 7 Drawing Sheets

FIG. 3
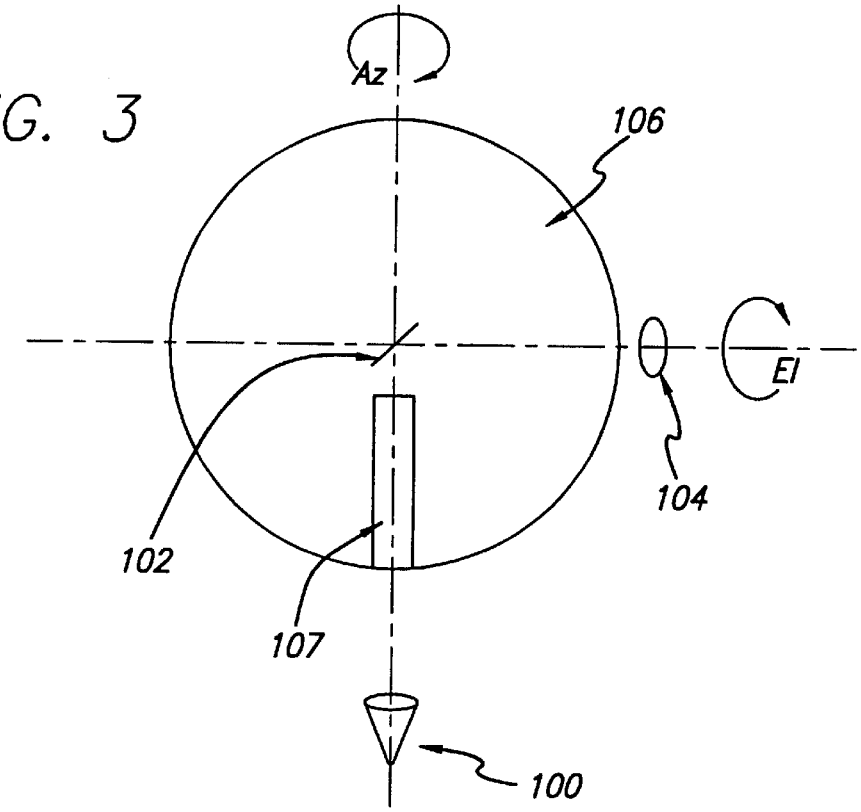
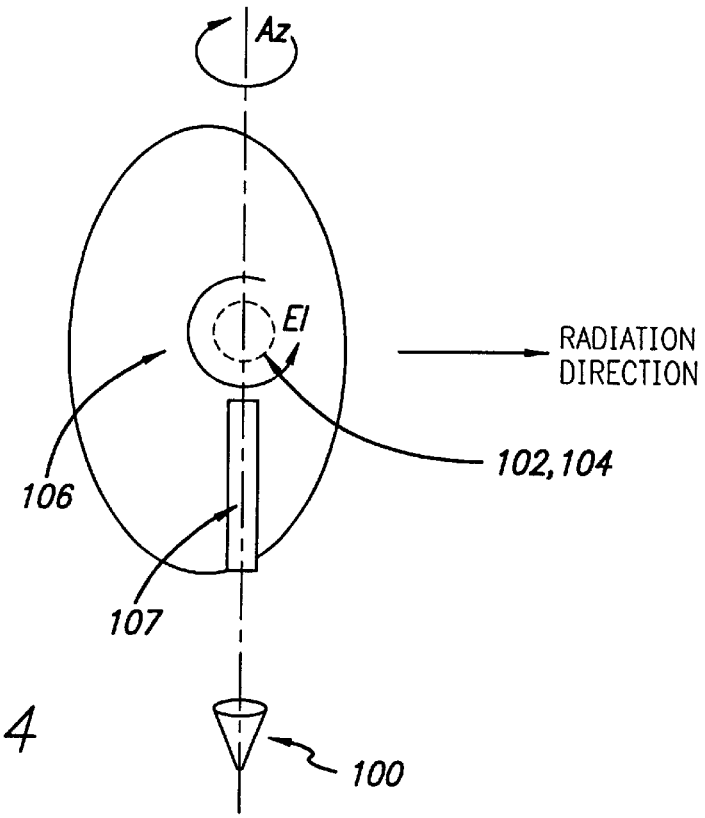
FIG. 4

FIG. 5
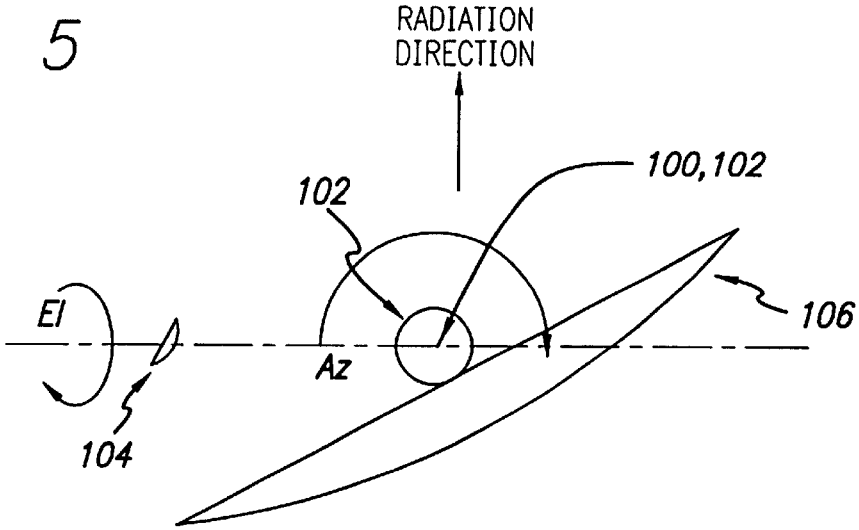
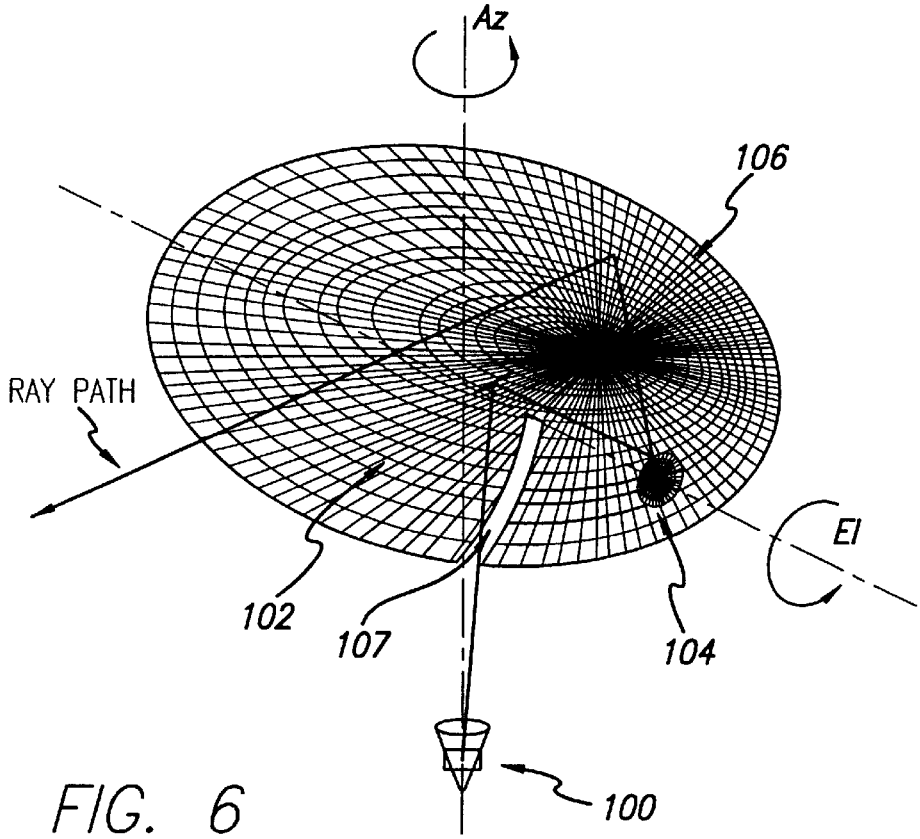
FIG. 6

SINGLE MIRROR DUAL AXIS BEAM WAVEGUIDE ANTENNA SYSTEM

This invention was made with government support under Contract #F29601-96-C-0031 awarded by the Air Force. The Government has certain rights in this invention.

BACKGROUND OF THE INVENTION

1. Field of the Invention

The present invention relates to antenna systems. More specifically, the present invention relates to single mirror, dual axis beam waveguide antenna systems.

2. Description of the Related Art

A large aperture antenna is used for satellite communications. Such antennas are generally of the fully steerable type, whereby a communication satellite can be tracked anywhere in the sky.

Various mount systems have been developed for driving such a large aperture antenna. For example, the Jet Propulsion Laboratory employs a large aperture array in its deep space network (DSN). It will be appreciated that the DSN antennas transmit an enormous amount of power due to the extremely long communication distances, e.g., Earth to Jupiter. Because of the large transmitters employed, it is impractical to mount the transmitter on the back of the antenna. Moreover, due to the high power involved, conventional waveguide rotary joints are not feasible. Thus, four-mirror beam waveguide antenna feeds are used in high power space communication systems such as the DSN. A beam waveguide antenna feed is a system that employs a series of mirrors, allowing a reflector antenna to be rotated about one or more axis, while keeping the feed horn and transmitter stationary. Typical systems are disclosed in U.S. Pat. No. 4,044,361 and U.S. Pat. No. 4,186,401, which patents are incorporated herein by reference. These types of beam-waveguide systems are most commonly encountered in high-performance aerial systems, where easy access to the transmitting and receiving equipment is a desirable feature.

One of the drawbacks of multiple mirror arrangements, such as four-mirror beam waveguide antenna feeds, relates to alignment. The more mirrors in a beam waveguide system, the more complicated it is to not only initially align the mirrors, but to maintain alignment over long periods of time.

For a stationary communication system such as the DSN system, the alignment of a beam waveguide system can be maintained. However, some high power systems are required to be portable. The designers of some portable high power systems have not used beam waveguide systems for the specific reason that the mirrors would become misaligned while the system is being transported.

Another drawback of the multiple mirror arrangements relates to power loss. Each mirror contributes a small amount of loss to the microwave beam due to conduction and diffraction. Thus, more mirrors lead to more power loss.

What is needed is a beam waveguide system which uses fewer mirrors. What is also needed is a portable beam waveguide system having improved alignment stability. It would be desirable if the portable beam waveguide system were suitable to a broad spectrum of antenna designs. What is also needed is a dual-axis beam waveguide antenna system wherein the axes of rotation are located near the center of gravity of the main reflector antenna, allowing for a lighter-weight gimbaling system.

SUMMARY OF THE INVENTION

The need in the art is addressed by an antenna system constructed in accordance with the present teachings. The inventive system includes a radiator, a mirror, a subreflector and a main reflector arranged in the recited order along a beam path from the radiator to the main reflector. Advantageously, the radiator and the mirror define an azimuth axis while the mirror and the subreflector define an elevation axis. Preferably, the bearing of the antenna system is varied by rotating the main and sub reflectors and the mirror about the azimuth axis while the elevation of the antenna system is varied by rotating main and sub reflectors about the elevation axis. In an exemplary case, the mirror is disposed at the intersection of the azimuth axis and the elevation axis.

A dual axis beam waveguide antenna system constructed in accordance with the present teachings advantageously includes a radiator generating a beam, a mirror which directs the beam to a subreflector, which receives the beam, and a main reflector illuminated by the subreflector, which generates a collimated output. The antenna system is characterized by an azimuth axis defined by the radiator and the mirror and an elevation axis defined by the mirror and the subreflector.

In a preferred embodiment of the inventive antenna system, the main reflector includes a slot in the main reflector disposed in a portion of the main reflector corresponding to intersection of the main reflector and the azimuth axis when the main reflector is rotated about the elevation axis. In an alternative embodiment, the azimuth axis is offset from vertical by a predetermined angle to thereby increase the maximum elevation angle of the antenna system.

Moreover, a dual axis beam waveguide antenna system constructed in accordance with the present teachings should include a radiator generating a beam, a mirror which directs the beam to a subreflector, which receives the beam, and a main reflector which is illuminated by the subreflector and which generates a collimated output. The antenna system is characterized in that the mirror and the subreflector are disposed on the same side of the main reflector. Preferably, the radiator and the mirror define an azimuth axis while the mirror and the subreflector define an elevation axis. In operation, the bearing of the antenna system is varied by rotating the main and the sub reflectors and the mirror about the azimuth axis while the elevation of the antenna system is varied by rotating the main and the sub reflectors about the elevation axis.

BRIEF DESCRIPTION OF THE DRAWINGS

FIGS. 3–6 illustrate one preferred embodiment of an antenna system employing a beam waveguide subsystem according to the present invention.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

The main purpose of any beam waveguide system is to function as a rotary joint, since it often necessary to steer a reflector antenna, both in azimuth and elevation, preferably while keeping the transmitter and feed stationary. A "beam waveguide" system of mirrors allows such steering to be performed.

Figure 1:
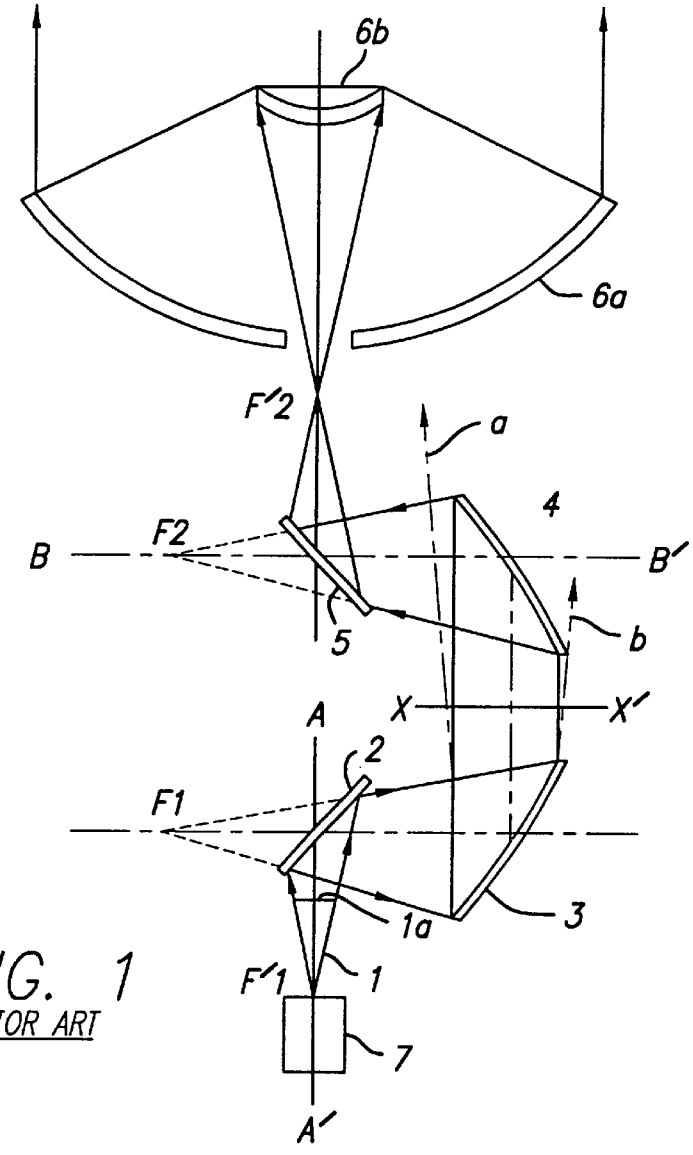
FIG. 1 PRIOR ART
FIG. 1 illustrates an antenna including a conventional four mirror beam waveguide subsystem.

As previously discussed, a typical beam waveguide system is shown in FIG. 1 of U.S. Pat. No. 4,186,402, wherein a primary feed 1 includes an electromagnetic horn having its aperture 1*a* placed with its focal point coincident with focal point $F_1'$ of the beam, waveguide system. This focal point $F_1'$ is the image of focal point $F_1'$ of the paraboloid reflector 3, as reflected by plane reflector 2. Axis ASA' is the azimuth axis of the aerial system. The transmitted electromagnetic wave travels from the primary feed 1 to the first plane reflector 2 where it is directed towards the first paraboloid reflector 3. Since paraboloid reflector 3 lies obliquely to the incident direction of the wave, the wave is distorted on reflection. In order to cancel out this distortion, the second paraboloid reflector 4, lying on the elevation axis of the aerial system, is made to be a mirror image in plane XnX' of the first paraboloid reflector 3. The wave directed to the second paraboloid reflector 4 from the first paraboloid reflector 3 is thus reflected towards focal point $F_2$ with the distortions introduced by the two oblique paraboloid reflectors largely canceled out due to their symmetrical disposition.

Between the second paraboloid reflector 4 and the focal point $F_2'$ is interposed a second plane reflector 5 which re-directs the wave to a new focus at $F_2'$ which is arranged to coincide with the focal point of a dual-reflector aerial 6*a*, 6*b* which may be of Cassegrainian or Gregorian type, or one of the constant aperture-phase microwave analogues of either of these two types.

Since the focal points of the primary feed and the dual-reflector aerial coincide with those of the four-reflector beam-waveguide feed and the distortions in the beam waveguide system are largely canceled out, it is almost as if the primary feed were located at the focus of the dual-reflector aerial and an aerial system having good performance characteristics can be constructed, with the advantage over other types that the primary feed 1 and the transmitting and receiving equipment 7 desired to be connected closely with it can be located in a stationary room at or near ground level thereby allowing easy access for operation and maintenance, while the aerial can be steered as required to point towards the satellite.

The type of beam-waveguide system described above has been used in high-performance aerial systems, where having easy access to the transmitting and receiving equipment is a desirable feature. In the system illustrated in FIG. 1, the beam from a stationary feed horn 1 illuminates the first mirror 2 of the beam waveguide system. The beam is reflected off this first mirror onto mirror 3 and, subsequently, is reflected off mirrors 3, 4 and 5, until the beam hits the subreflector 6*b* of an axially symmetric Cassegrain reflector system. The beam is reflected off the subreflector 6*b* unto the main reflector antenna 6*a*, where it is then collimated upon reflection and radiated. In order to steer the antenna in azimuth, the four beam waveguide mirrors 2–5, as well as the sub and main reflectors 6*b* and 6*a*, respectively, are rotated about the azimuth rotation axis A–A'. In order to steer the antenna in elevation, mirror 4 as well as the sub and main reflectors 6*b* and 6*a* are rotated about the elevation rotation axis B–B'. This allows the feed (and thus the transmitter) to be stationary.

Figure 2:
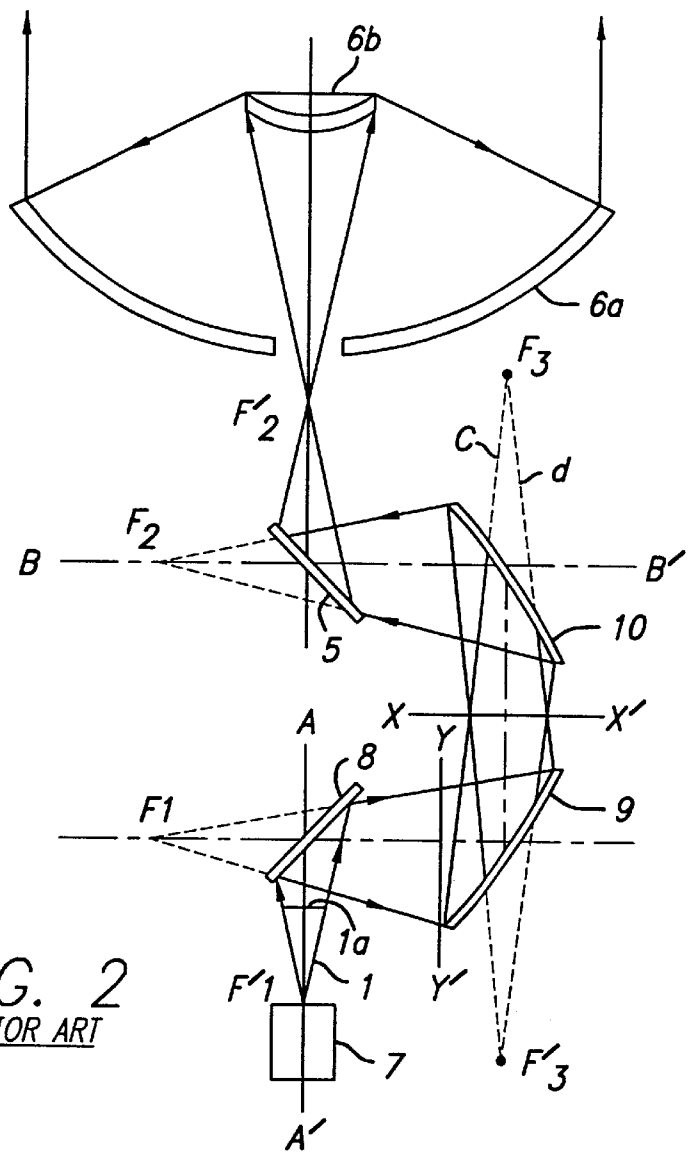
FIG. 2 PRIOR ART
FIG. 2 illustrates a variation of the four mirror beam waveguide subsystem depicted in FIG. 1.

Often, mirrors 2 and 5 are flat, while mirrors 3 and 4 are paraboloidal. If the focal lengths of the paraboloids (mirrors 3 and 4) are equal, then the cross polarization through the system is minimized. It will be appreciated that low cross polarization is important in some communication systems. Many other combinations of mirrors are possible with the standard 4 mirror configuration shown in FIG. 1. For example, FIG. 2 illustrates an alternative configuration wherein an electromagnetic wave generated by a transmitter located in the communications equipment room 7 is radiated from an electromagnetic horn 1 such that it forms an axially symmetric spherical wave with its apparent origin at focal point $F_1'$. The wave is then reflected through an angle of ninety degrees by an offset hyperboloid reflector 8, which is shaped so that an exact, predetermined amount of distortion is introduced into the wave. Subsequently the wave is further reflected by a pair of offset ellipsoid reflectors 9 and 10 which are arranged to be mirror images of each other. By further reflection at a plane reflector 5 the wave is brought to a focus at focal point $F_2'$ which is arranged to coincide with the focal point of the dual-reflector aerial 6*a*, 6*b* with the result that the wave reflected onto the main reflector 6*a* from the subreflector 6*b* is then reflected along the axis of the main reflector in the form of a narrow-beam plane wave.

The systems illustrated in FIGS. 1 and 2 are most commonly employed in high power-space communication systems, e.g., the JPL deep space network (DSN). One of the drawbacks of having multiple mirrors, such as the prior art system in FIG. 1, is alignment problems. The more mirrors in a beam waveguide system, the more complicated it is to not only initially align the mirrors, but to maintain alignment over long periods of time. For a stationary communication system such as the DSN system, the alignment of a beam waveguide system can be maintained. However, some high power systems are required to be portable. The designers of some portable high power systems have not used beam waveguide systems for the specific reason that the mirrors would become misaligned while the system is being transported.

A first preferred embodiment of the antenna system according to the present invention will now be described while referring to FIGS. 3–6, where FIG. 3 is a front view, FIG. 4 provides a side view, FIG. 5 depicts a top view and FIG. 6 provides an isometric view of the antenna system. It should be noted that all components are present, but not necessarily visible, in the various views. As shown in FIGS. 3–6, the beam from a stationary feed 100 is radiated up to a mirror 102 of the beam waveguide subsystem. See FIGS. 3 and 4. It will be appreciated that the center of mirror 102 advantageously is aligned with the center of the azimuth and elevation axes Az and El. See FIG. 6. It should be mentioned that mirror 102 rotates about the azimuth axis Az only.

Advantageously, mirror 102 reflects the beam towards the subreflector 104, as shown in FIGS. 3 and 5. The beam is then reflected off the subreflector 104 towards the main reflector 106, where the beam is collimated and radiated. The sub and main reflectors 104, 106 rotate about the azimuth and elevation axes Az and El and advantageously are stationary with respect to each other. The sub and main reflectors 104, 106 comprise an offset Cassegrain or Gregorian reflector system, turned on its side. In the isometric view of FIG. 6, a ray path is shown reflecting through the new beam waveguide system.

It should be noted that in the antenna system illustrated in FIGS. 3–6 the main reflector 106 will interfere with the beam emitted by the feed horn 100 when the main reflector 106 when the elevation of the intended receiver, e.g., a satellite, is greater than a maximum elevation angle. In that case, there are several ways to increase the maximum elevation angle. For example, the main reflector 106 advantageously can include a notch 107, which notch would prevent the main reflector 106 from masking the beam produced by feed horn 100. Alternatively, the entire antenna system could be tilted by a predetermined angle, i.e., the axis Az could be titled by a predetermined angle, so that the main reflector 106 advantageously can illuminate a greater elevation angle. It will, of course, be appreciated that the notch 107 in main reflector 106 advantageously can be used in an antenna system having an axis Az tilted through a predetermined angle to further increase the maximum elevation angle accommodated by the antenna system according to the present invention.

It should also be noted that mirror 102 advantageously can be configured as a flat mirror, a paraboloid mirror, a hyperboloid mirror or a ellipsoid mirror; in fact, the mirror 102 could even be a special, i.e., custom shape. It should be mentioned that when mirror 102 is configured as a flat mirror, the offset Cassegrain or Gregorian antenna system, the combination of the sub and main reflectors 104, 106 can be configured to have zero cross polarization (from a geometry optics standpoint), similar to what was accomplished in the output stage of prior art antenna systems. It will be appreciated that this would enable the preferred embodiment according to the present invention discussed above be employed in a low cross polarization application such as communications. It should also be mentioned that the offset Cassegrain or Gregorian system, i.e., the combination of the sub and main reflectors 104, 106 can also be configured to thereby produce a non-classical shaped system.

Figure 7:
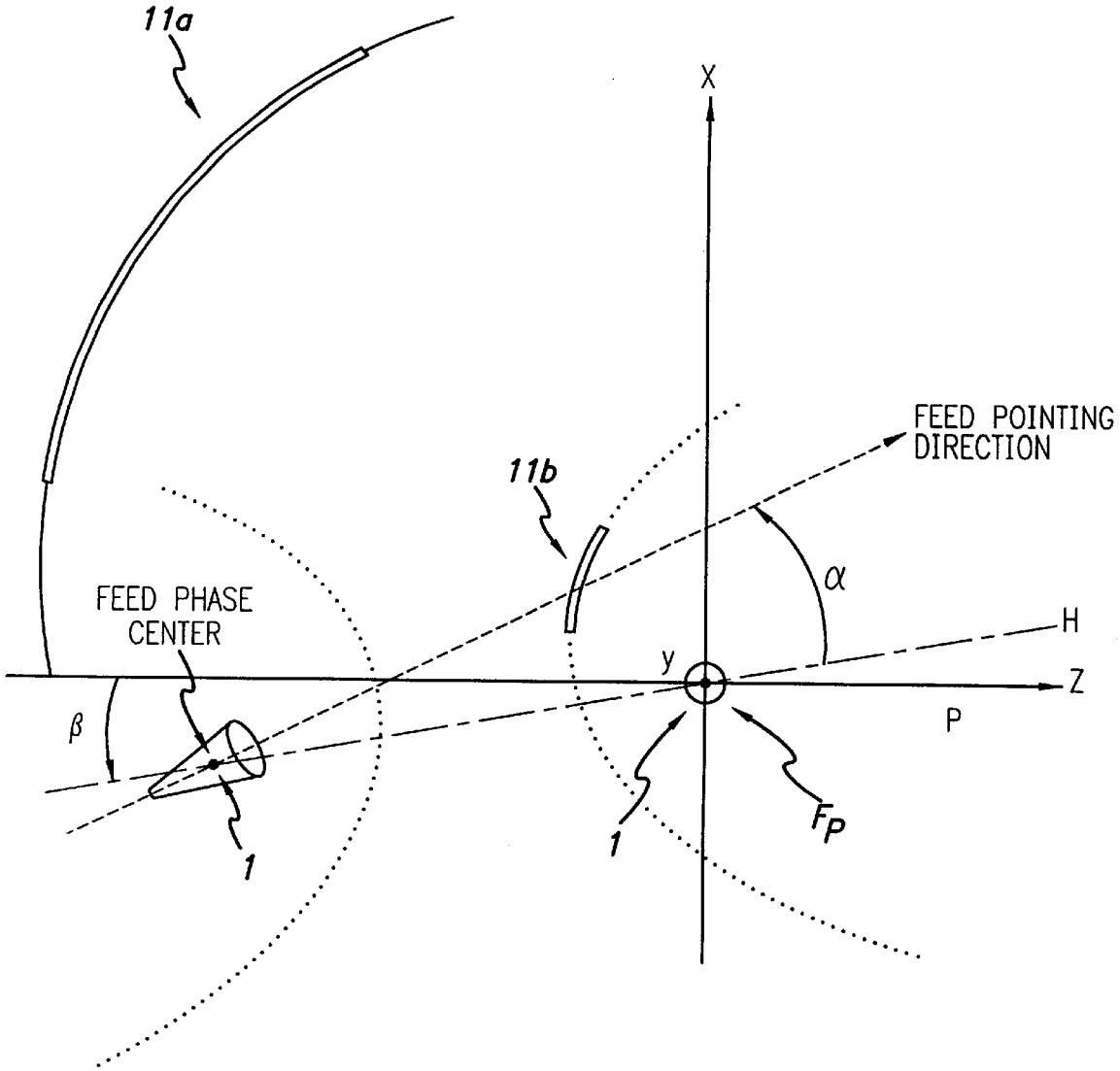
FIG. 7 PRIOR ART
FIG. 7 illustrates the operation of a conventional antenna.
Figure 9:
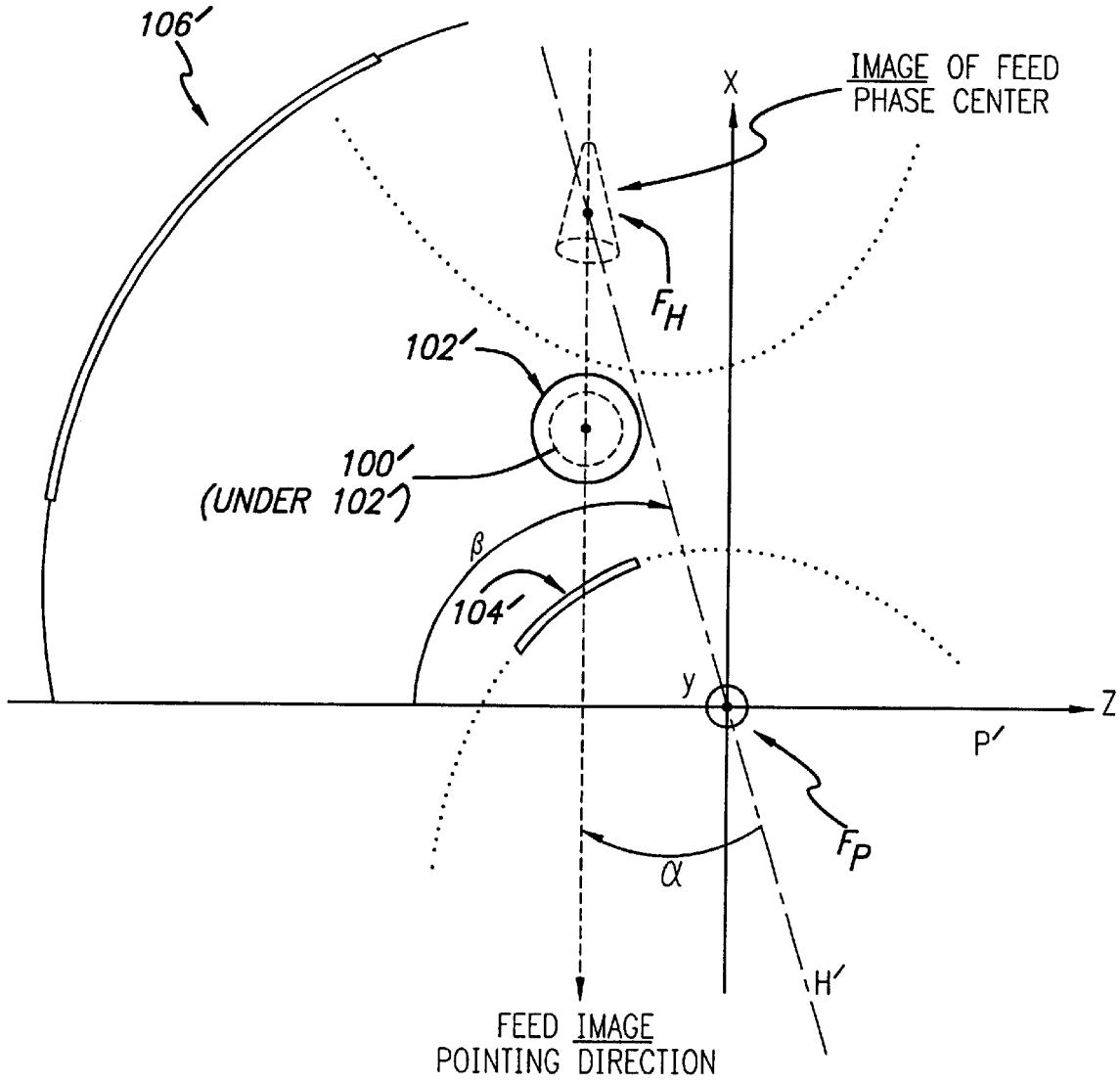

The design/operation of the invention shown in FIGS. 3–6 can best be understood by considering operation of the sub and main reflectors as an offset Cassegrain system in both the conventional arrangement illustrated in FIG. 7 and the novel arrangement illustrated in FIG. 9. The typical convention employed in a traditional offset Cassegrain system is shown in FIG. 7. Additional details regarding this arrangement are provided in the article by Brown, Prata, entitled "A Design Procedure for Classical Offset Dual Reflector Antennas with Circular Apertures," (*IEEE Trans. Antennas Propagat.*, Vol. AP-42, No. 8, pp. 1145–1153, August 1994). This offset Cassegrain system is comprised of a feed 1, a hyperboloidal subreflector 11*b* and a paraboloidal main reflector 11*a*. The hyperboloid axis H is tilted with respect to the axis of the main reflector 11*a* by an angle β. The feed 1 is pointed towards the center of the sub reflector 11*b*. This feed pointing direction is defined by the angle α with respect to the hyperboloid axis H. Typically, the feed 1 is positioned below the paraboloid axis P as shown in FIG. 7. The hyperboloidal subreflector 11*b* has focal points located at the feed phase center and at the paraboloid focal point $F_P$. Therefore, a ray emanating from the feed phase center will reflect off the subreflector 11*b*, appearing to have originated at the paraboloid focal point $F_P$. The ray then hits the main reflector 11*a* and travels in the z-direction, i.e., along the paraboloid axis P. The main beam is therefore radiated in the z-direction.

Figure 8:
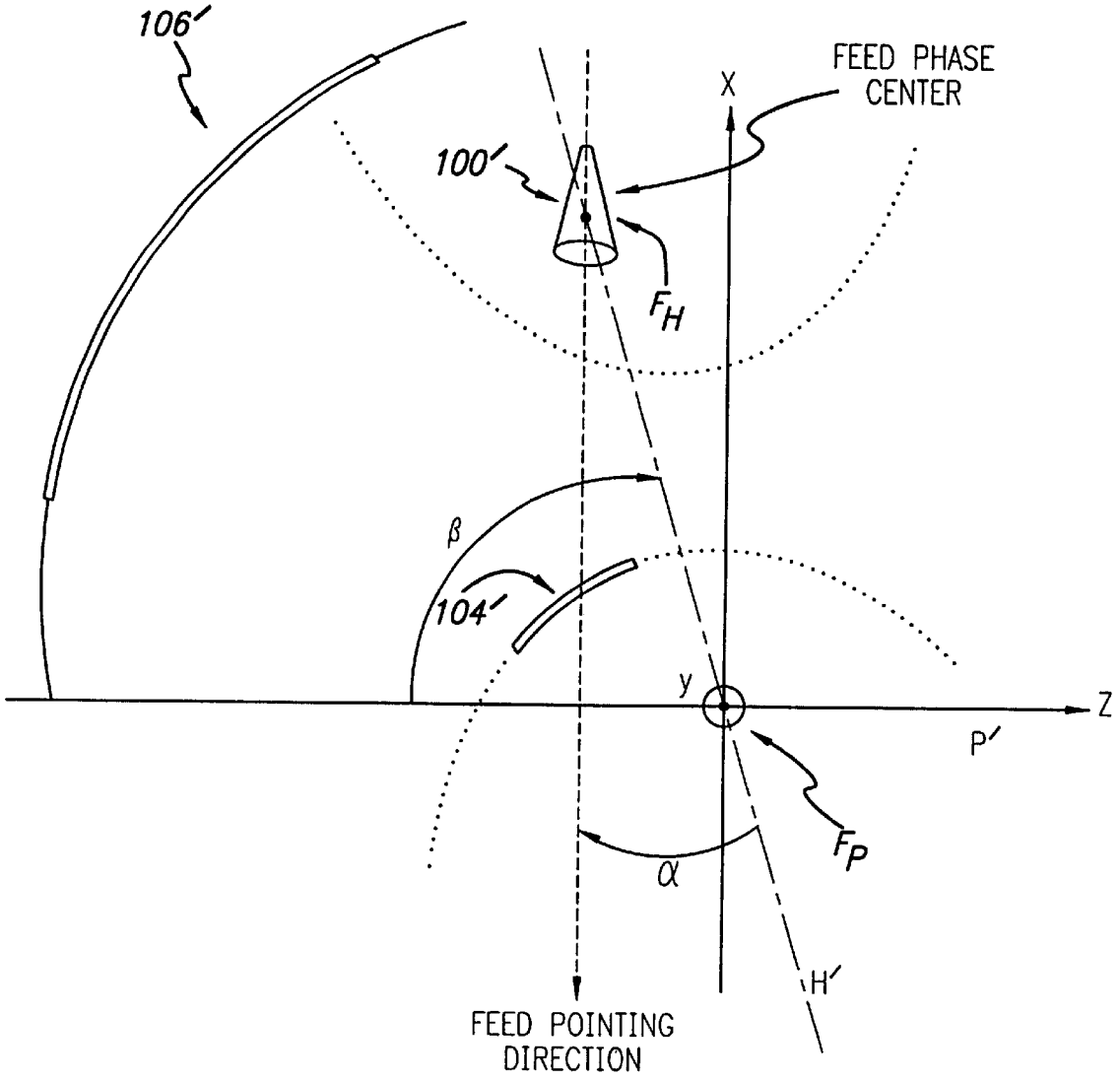
FIGS. 8 and 9 collectively illustrate the operation of another preferred embodiment according to the present invention.

Now envision the feed being repositioned as shown in FIG. 8. Here the feed 100' is moved above the paraboloid axis P' such that the hyperboloid axis H' is tilted nearly vertical. The feed 100' is positioned such that it is pointed straight down towards the subreflector 104' (α+β=90 degrees). In this configuration, the axis of the feed is parallel to the x-axis. Since the direction of the main beam is along the z-axis, this offset Cassegrain can be steered in the y-z plane by rotating the sub and main reflectors 104', 106' about the feed axis F, without rotating the feed itself. Therefore, the Cassegrain system illustrated in FIG. 8 advantageously can be considered a single-axis beam waveguide system.

Now another axis of rotation advantageously can be added to the system illustrated in FIG. 8 by including a 45-degree flat mirror 102', as shown in FIG. 9. Here, the feed 100' is preferably positioned below the flat mirror 102' (in the −Y direction), such that its pointing direction is parallel to the y-axis. The flat mirror 102' creates an image of the feed 100' as if it was still located at the hyperboloid focal point $F_H$. By rotating the sub and main reflectors 104', 106' about the "imaged" feed axis, the antenna system illustrated in FIG. 9 advantageously can still be steered in the y-z plane as before. However, when mirror 102' and the sub and main reflectors 104', 106' are rotated about the feed axis F, the main beam can also be steered in the z-x plane. Therefore, the antenna system depicted in FIG. 9 possesses two axes of rotation for a fixed feed 100'. Therefore, as illustrated in FIGS. 8 and 9 collectively, in order to form an elevation over azimuth beam waveguide-fed antenna system, the feed axis F can be made the azimuth rotation axis Az and the "imaged" feed axis an be made the elevation rotation axis El.

Figure 10:
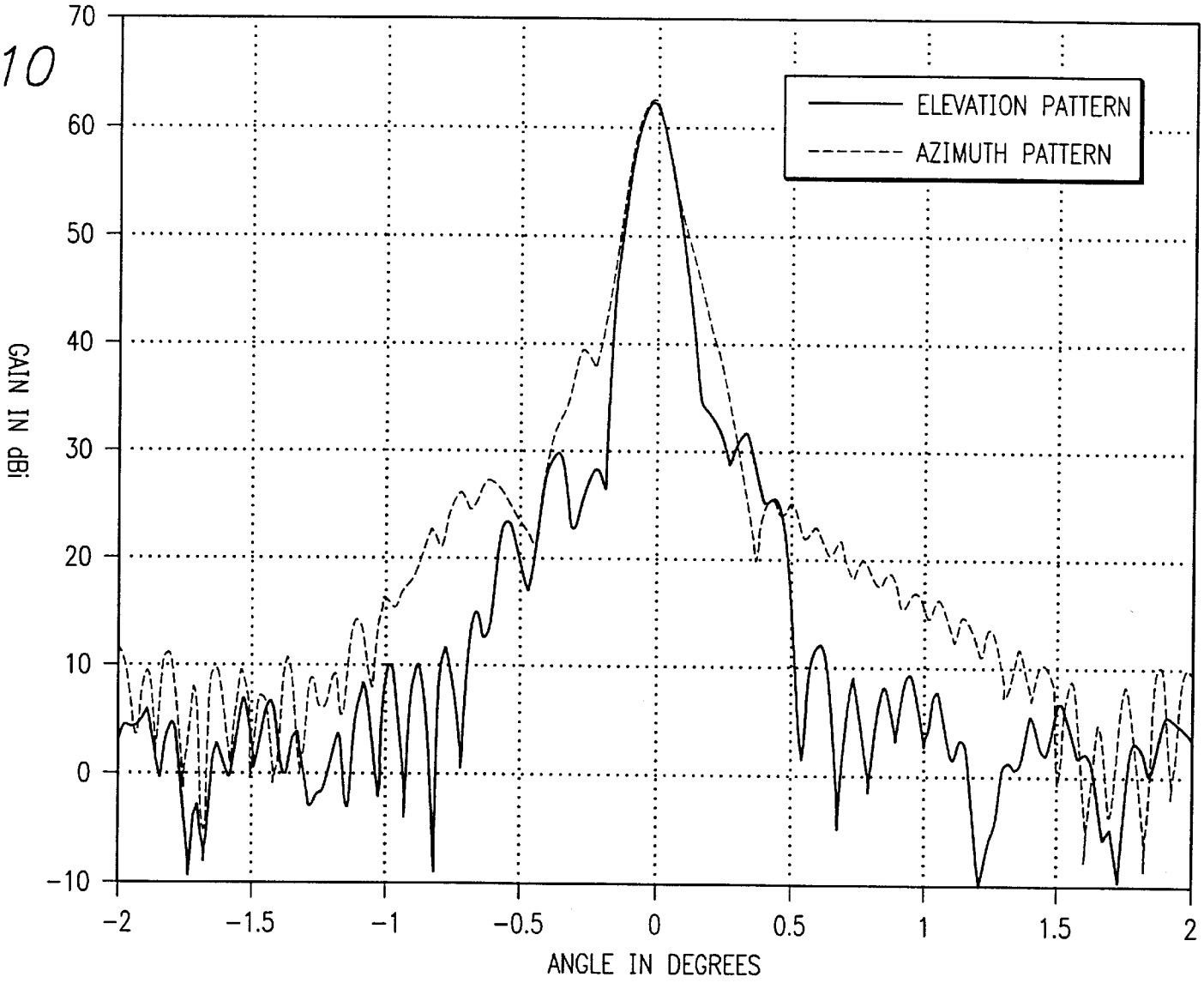
FIG. 10 depicts the beam pattern generated by the antenna system illustrated in FIGS. 3–6.

It should be mentioned that the performance of the system illustrated in FIGS. 3–6 as simulated on a computer using a physical optics computation code. In this analysis, the feed horn 100, which is assumed to generate a gaussian beam, feeds the mirror 102 of the beam waveguide system. The current density on mirror 102 is determined using the physical optics current approximation. The magnetic field generated by the current density on the mirror 102, which is incident on the sub-reflector 104, is then computed using a free-space Green's function. This process is repeated whereby the current density is computed on the main reflector 106. The far field pattern of the main reflector 106 is then computed. The result of this computation is shown in FIG. 10 for the azimuth and elevation planes. For this analysis, the main reflector 106 was assumed to be 625 wavelengths in diameter with a 10 dB aperture illumination taper.

The predicted antenna pattern, arrived at using the above-described method, shows the gain of the antenna to be approximately 63 dBi, which represents an efficiency of about 50 percent. Much higher efficiencies, i.e., efficiencies of greater than 80 percent, advantageously can be obtained with a nontraditional shaped design on the sub and main reflectors of the system, which yields an almost uniform aperture illumination. It is important to note that this particular design evaluated in FIG. 10 utilized a paraboloid as the mirror 102, resulting in some cross polarization and, thus, an unsymmetric beam pattern in both the elevation and azimuth planes.

From the discussion above, it will be appreciated that the antenna system employing the novel dual axis waveguide subsystem according to the present invention has several advantages over the conventional dual axis beam waveguide systems illustrated in FIGS. 1 and 2. A non-exhaustive list of the advantages of the present invention over prior art beam waveguide systems includes:

1. The antenna system according to the present invention requires a single mirror where prior art beam waveguide systems required four, thus reducing the complexity and loss of the system;
2. Since the antenna system according to the present invention only requires a single mirror, the problem of mirror alignment is reduced. This is a big advantage for portable systems utilizing beam waveguides; and
3. The elevation axis of rotation of the antenna system according to the present invention advantageously is disposed at the center of gravity of the main reflector antenna, allowing for a lighter-weight gimbaling system. It will be noted form FIGS. 1 and 2 that prior art beam waveguide systems rotated the antenna, in the elevation plane, at a point far below the center of gravity of the antenna.

It should be mentioned that the antenna system featuring the novel dual axis beam waveguide feed advantageously can be used on high power directed energy systems. In addition, the present invention has great marketing appeal due to the drastic reduction in the required number of mirrors.

Thus, the present invention has been described herein with reference to a particular embodiment for a particular application. Those having ordinary skill in the art and access to the present teachings will recognize additional modifications applications and embodiments within the scope thereof.

It is therefore intended by the appended claims to cover any and all such applications, modifications and embodiments within the scope of the present invention.

Accordingly,

What is claimed is:

1. A dual axis beam waveguide antenna system comprising:

a radiator generating a beam;

a mirror which directs the beam to a subreflector;

the subreflector which receives the beam; and a main reflector which is illuminated by the subreflector and which generates a collimated output, wherein:

the radiator and the mirror define an azimuth axis;

the mirror and the subreflector define an elevation axis;

a beam pointing angle of the antenna system is varied by rotating main and subreflectors about the azimuth axis;

the elevation of the antenna system is varied by rotating the main and the sub reflectors and the mirror about the elevation axis; and the mirror and the subreflector are disposed on the same side of the main reflector.

2. The antenna system as recited in claim 1 wherein the mirror is disposed at the intersection of the azimuth axis and the elevation axis.

3. The antenna system as recited in claim 1 wherein the main reflector includes a slot in the main reflector disposed in a portion of the main reflector corresponding to intersection of the main reflector and the azimuth axis when the main reflector is rotated about the elevation axis.

4. The antenna system as recited in claim 1 wherein the azimuth axis is offset from vertical by a predetermined angle to thereby increase the maximum elevation angle of the antenna system.

5. The antenna system as recited in claim 1 wherein the subreflector and main reflector comprise an offset Cassegrain reflector System.

6. The antenna system as recited in claim 1 wherein the subreflector and the main reflector comprise or offset Gregorian reflector system.

7. The antenna system as recited in claim 1 wherein the mirror is disposed substantially at the center of gravity of the main reflector.

8. The antenna system as recited in claim 1 wherein the mirror has a shape other than a flat, a parabolic, a hyperbolic and an elliptical surface.

* * * * *

UNITED STATES PATENT AND TRADEMARK OFFICE

CERTIFICATE OF CORRECTION

PATENT NO. : 6,243,047 B1
DATED : June 5, 2001
INVENTOR(S) : Kenneth W. Brown

It is certified that error appears in the above-identified patent and that said Letters Patent is hereby corrected as shown below:

Column 1,
Line 3, please insert the following paragraph:

-- This invention was made with Government support under Contract No. F29601-96-C-0031 awarded by the Department of the Air Force. The Government has certain rights in this invention. --

Signed and Sealed this

Twenty-first Day of January, 2003

JAMES E. ROGAN
*Director of the United States Patent and Trademark Office*